US005641007A

United States Patent [19]

Falk

[11] Patent Number: 5,641,007

[45] Date of Patent: Jun. 24, 1997

[54] PAINT BRUSH AND ROLLER DRAINING DEVICE

[76] Inventor: Peter M. Falk, 30640 Dawson St., Garden City, Mich. 48135

[21] Appl. No.: 599,329

[22] Filed: Feb. 9, 1996

[51] Int. Cl.[6] ..... B67C 11/00

[52] U.S. Cl. ..... 141/106; 141/86; 141/332; 141/340; 248/110; 248/692; 211/66; 211/87; 206/209.1; 206/362.1; 220/570; 220/571; 220/571.1; 220/476; 220/482; 220/697

[58] Field of Search ..... 220/476, 480–482, 220/570–572, 697; 206/209, 209.1, 361–362.3; 141/86, 88, 106, 332, 340, 364, 375; 211/65, 66, 87, 88; 15/257.05, 257.06; 248/110, 692

[56] References Cited

U.S. PATENT DOCUMENTS

| | | | |
|---|---|---|---|
| 92,791 | 7/1869 | Burwell | 141/106 |
| 421,754 | 2/1890 | Pannill | 141/106 |
| 478,303 | 7/1892 | Allgood | 141/106 |
| 578,671 | 3/1897 | Wisdom | 141/106 |
| 1,102,284 | 7/1914 | Miller | 206/362 |
| 3,654,969 | 4/1972 | Vazquez et al. | 141/106 |
| 5,016,773 | 5/1991 | Lockwood | 220/697 |
| 5,097,967 | 3/1992 | Sica | 211/66 |
| 5,314,061 | 5/1994 | Bedrossian | 220/697 X |

FOREIGN PATENT DOCUMENTS

| | | | |
|---|---|---|---|
| 13437 | 6/1913 | United Kingdom | 211/65 |

*Primary Examiner*—J. Casimer Jacyna

[57] ABSTRACT

The present invention relates to a device which can support a plurality of paint brushes and/or paint rollers and enable them to drain in an efficient manner. In its broadest context, the present invention includes a housing having rear wall component and a container component. The container includes a bottom surface which is tapered inwardly toward a draining aperture. This draining aperture can be connected to a receptacle by way of a length of tubing. Thus, the user of the device can support it upon a wall or upon the edge of a bath tub. A number of brushes and/or paint rollers can then be supported within the container portion of the device and have any paint dripping therefrom run off into the bottom surface of the container through the tube and into a receptacle for disposal or reuse. The various components of the present invention, and the manner in which they interrelate, will be described in greater detail hereinafter.

4 Claims, 3 Drawing Sheets

FIG 3
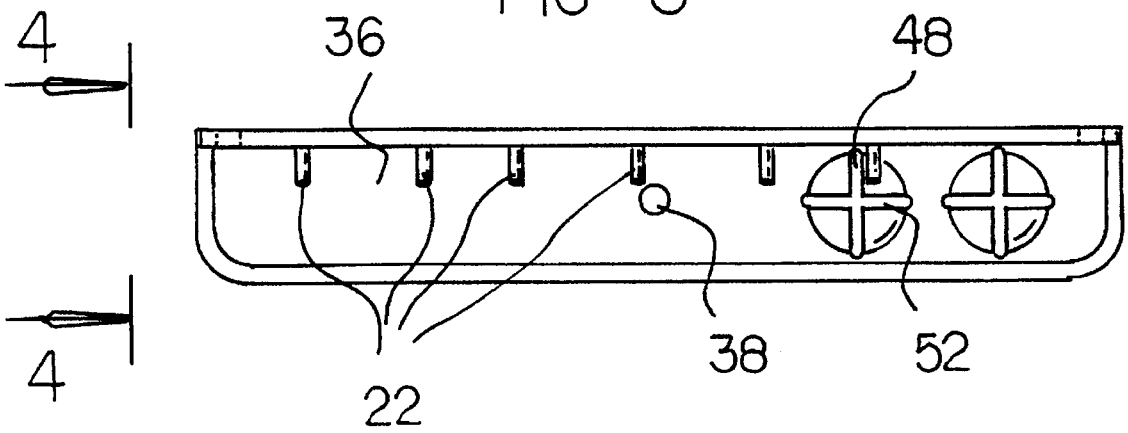
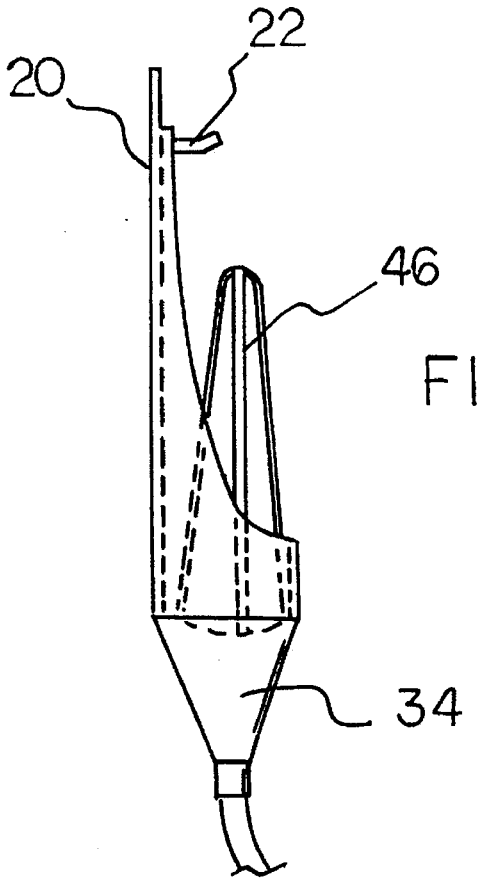
FIG 4

PAINT BRUSH AND ROLLER DRAINING DEVICE

BACKGROUND OF THE INVENTION

1. Field of the Invention

The present invention relates to a paint brush and roller draining device and, more particularly, pertains to a device for aiding the removal of excess paint from a paint brush and/or roller.

2. Description of the Prior Art

The use of paint brush hangers is known in the prior art. More specifically, paint brush hangers heretofore devised and utilized for the purpose of devices for drip drying paint brushes are known to consist basically of familiar, expected and obvious structural configurations, notwithstanding the myriad of designs encompassed by the crowded prior art which have been developed for the fulfillment of countless objectives and requirements.

By way of example, the prior art in U.S. Pat. No. 3,432,875 to Edelson; U.S. Pat. No. 4,949,864 to LaKier; and U.S. Pat. No. 5,341,969 to Accardo et al., each disclose paint brush folder or hanger assemblies. Furthermore, U.S. Pat. No. 5,097,967 to Sica; U.S. Pat. No. 5,097,965 to Fehr and U.S. Pat. No. 5,016,773 to Lockwood each disclose paint brush cleaning and/or draining devices.

In this respect, the paint brush and roller draining device according to the present invention substantially departs from the conventional concepts and designs of the prior art, and in so doing provides an apparatus primarily developed for the purpose of device for aiding the removal of excess paint from a paint brush and/or roller.

Therefore, it can be appreciated that there exists a continuing need for new and improved paint brush and roller draining device which can be used for device for aiding the removal of excess paint from a paint brush and/or roller. In this regard, the present invention substantially fulfills this need.

SUMMARY OF THE INVENTION

In view of the foregoing disadvantages inherent in the known types of paint brush hangers now present in the prior art, the present invention provides an improved paint brush and roller draining device. As such, the general purpose of the present invention, which will be described subsequently in greater detail, is to provide a new and improved paint brush and roller training device apparatus and method which has all the advantages of the prior art and none of the disadvantages.

To attain this, the present invention essentially comprises a new and improved paint brush and roller draining device comprising, in combination, a rear wall having an upper extent, a lower extent, a first side and a second side. A plurality of hooks extend outwardly from the upper extent of the rear wall. Each of the hooks functions to support a brush. A first plurality of vertically aligned apertures are formed along the first side of the rear wall. A second plurality of vertically aligned apertures are formed along the second side of the rear wall wherein each of the vertically aligned apertures function to support the device. A first threaded aperture is formed through the lower extent of the rear wall adjacent the first side. A second threaded aperture is formed through the lower extent of the rear wall adjacent the second side. A container with a central extent is integrally formed with the rear wall. The container extends forwardly from the rear wall. The container has a bottom surface which tapers inwardly toward the central extent of the container. An aperture is formed within the bottom surface of the container at its central extent. A length of tubing has a first end and a second end. The first end is coupled to the aperture of the bottom surface of the container. A receptacle is adapted to receive runoff fluids. The second end of the tubing is positioned within the receptacle. A pair of roller receiving cones are provided. Each of the cones is defined by a first blade and a second blade. Each of the blades has a broad base and a narrow apex. The first and second blades are positioned 90 degrees relative to each other. The broad base portion of each cone is secured to the bottom surface of the container. Each of the cones is specifically adapted to have a roller positioned over it. A wall receiving slot is defined intermediate the lower extent of the rear wall and the container. A first screw is threadedly received within the first threaded aperture of the rear wall. A second screw is threadedly received within the second threaded aperture of the rear wall. The first and second screws function to secure a wall within the wall receiving slot.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved paint brush and roller draining device which has all the advantages of the prior art paint brush hangers and none of the disadvantages.

It is another object of the present invention to provide a new and improved paint brush and roller draining device which may be easily and efficiently manufactured and marketed.

It is a further object of the present invention to provide a new and improved paint brush and roller draining device which is of a durable and reliable construction.

An even further object of the present invention is to provide a new and improved paint brush and roller draining device which is susceptible of a low cost of manufacture with regard to both materials and labor, and which accordingly is then susceptible of low prices of sale to the consuming public, thereby making such paint brush hangers economically available to the buying public.

Still yet another object of the present invention is to provide a new and improved paint brush and roller draining device which provides in the apparatuses and methods of the prior art some of the advantages thereof, while simultaneously overcoming some of the disadvantages normally associated therewith.

Still another object of the present invention is to device for aiding the removal of excess paint from a paint brush and/or roller.

Lastly, it is an object of the present invention to provide a device which can support a plurality of paint brushes and/or paint rollers and enable them to drain in an efficient manner. In its broadest context, the present invention includes a housing having rear wall component and a container component. The container includes a bottom surface which is tapered inwardly toward a draining aperture. This draining aperture can be connected to a receptacle by way of a length of tubing. Thus, the user of the device can support it upon a wall or upon the edge of a bath tub. A number of brushes and/or paint rollers can then be supported within the container portion of the device and have any paint dripping therefrom run off into the bottom surface of the container through the tube and into a receptacle for disposal or reuse. The various components of the present invention, and the manner in which they interrelate, will be described in greater detail hereinafter.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a plan view of the device of the present invention.

FIG. 4 is a view taken long line 4—4 of FIG. 3.

Similar reference characters refer to similar parts throughout the several views of the drawings.

DESCRIPTION OF THE PREFERRED EMBODIMENT

Figure 1:
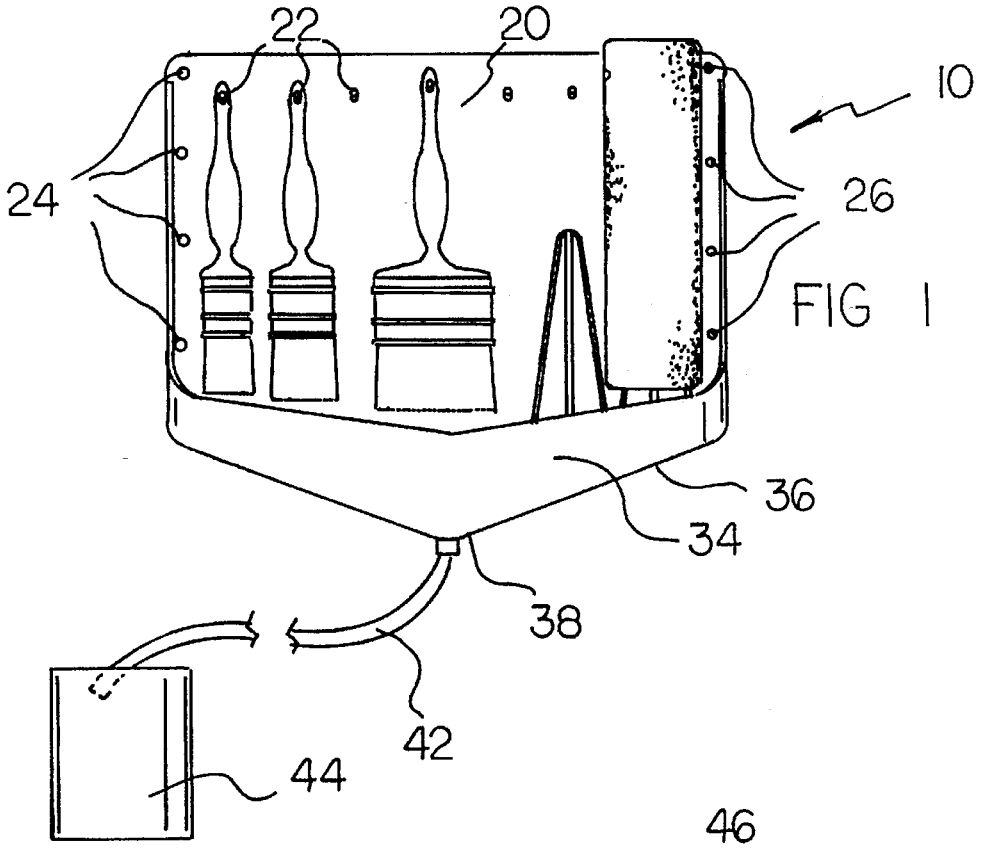
FIG. 1 is a front view of the paint brush and roller draining device with brushes and rollers included.

With reference now to the drawings, and in particular to FIG. 1 thereof, a new and improved paint brush and roller draining device embodying the principles and concepts of the present invention and generally designated by the reference numeral 10 will be described.

The present invention relates to a device which can support a plurality of paint brushes and/or paint rollers and enable them to drain in an efficient manner. In its broadest context, the present invention includes a housing having rear wall component and a container component. The container includes a bottom surface which is tapered inwardly toward a draining aperture. This draining aperture can be connected to a receptacle by way of a length of tubing. Thus, the user of the device can support it upon a wall or upon the edge of a bath tub. A number of brushes and/or paint rollers can then be supported within the container portion of the device and have any paint dripping therefrom run off into the bottom surface of the container through the tube and into a receptacle for disposal or reuse. The various components of the present invention, and the manner in which they interrelate, will be described in greater detail hereinafter.

The rear wall 20 of the device 10 is defined by an upper extent, a lower extent, a first side and a second side. Furthermore, a plurality of hooks 22 extend outwardly from the upper extent of the rear wall 20. Each of these hooks function in supporting a paint brush. In the preferred embodiment, each of the hooks has an upturned outer extent to aid in more securely supporting a paint brush. The paint brushes as they are supported from the rear wall can most clearly be seen in FIG. 1. A first plurality of vertically aligned apertures 24 are formed along the first side of the rear wall 20. Likewise, a second plurality of vertically aligned apertures 26 are formed along the second side of the rear wall. These vertically aligned apertures function and support the device upon a wall. More specifically, the two sets of the vertically aligned apertures can be used in supporting the device on a wall by way of pegs which would be inserted within a pair of the horizontally aligned apertures. The rear wall further includes a first threaded aperture 28 and a second threaded aperture 32. The first threaded aperture 28 is formed through the lower extent of the rear wall adjacent the first side, while the second threaded aperture 32 is formed through the lower extent of the rear wall adjacent the second side. The function of these threaded apertures will be described in greater detail hereinafter.

A container 34, which is defined in part by a central extent, is integrally formed with the rear wall portion 20. This container 34 extends forwardly from the rear wall and has a bottom surface 36 which tapers inwardly toward the central extent. This tapering enables any run off fluids to be routed toward an aperture 38. This aperture is formed in the central extent of the container 34.

In order to deliver run off fluids from the device, a length of tubing 42 can be employed. This tubing 42 is defined by a first end and a second end wherein the first end is adapted to be coupled to the aperture 38. Furthermore, a receptacle 44 can be employed to receive run off fluids as they pass from the second end of the tubing 42. Specifically, the second end of the tubing 42 would be positioned within the receptacle 44 for the purposes of receiving run off fluids.

In order to employ the device of the present invention in conjunction with paint rollers, a pair of roller receiving cones 46 are included. Each of these cones 46 is defined by a first blade 48 and a second blade 52. Each of these blades includes a broad base and a narrow apex wherein the first and second blades are positioned ninety degrees relative to one another. This blade geometry can most clearly be seen in FIGS. 3 and 4. Furthermore, each of these cones is specifically adapted to have a roller positioned over it for the purposes of letting any excess paint upon the roller to drain therefrom.

Figure 5:
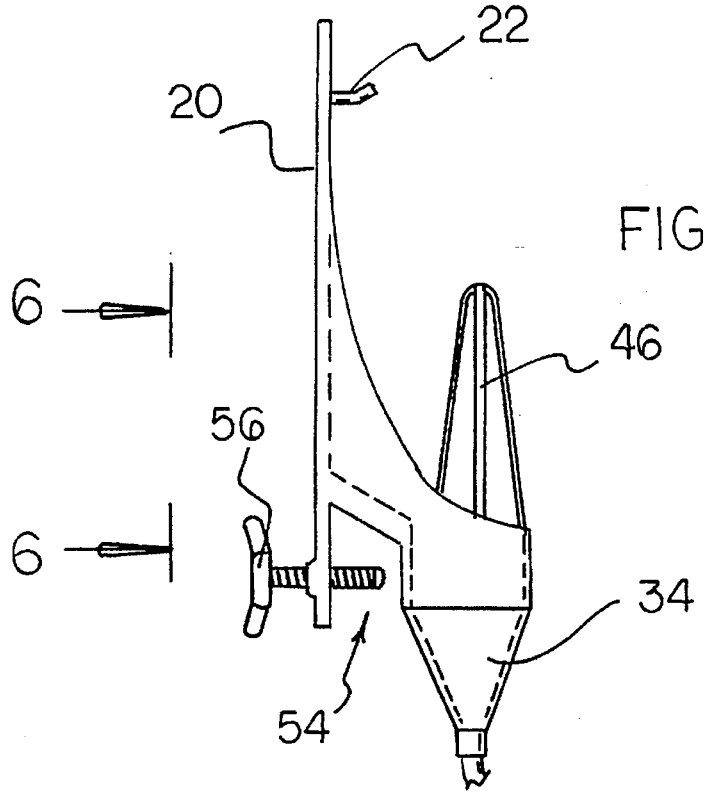
FIG. 5 is a view of the primary embodiment of the present invention.
Figure 6:
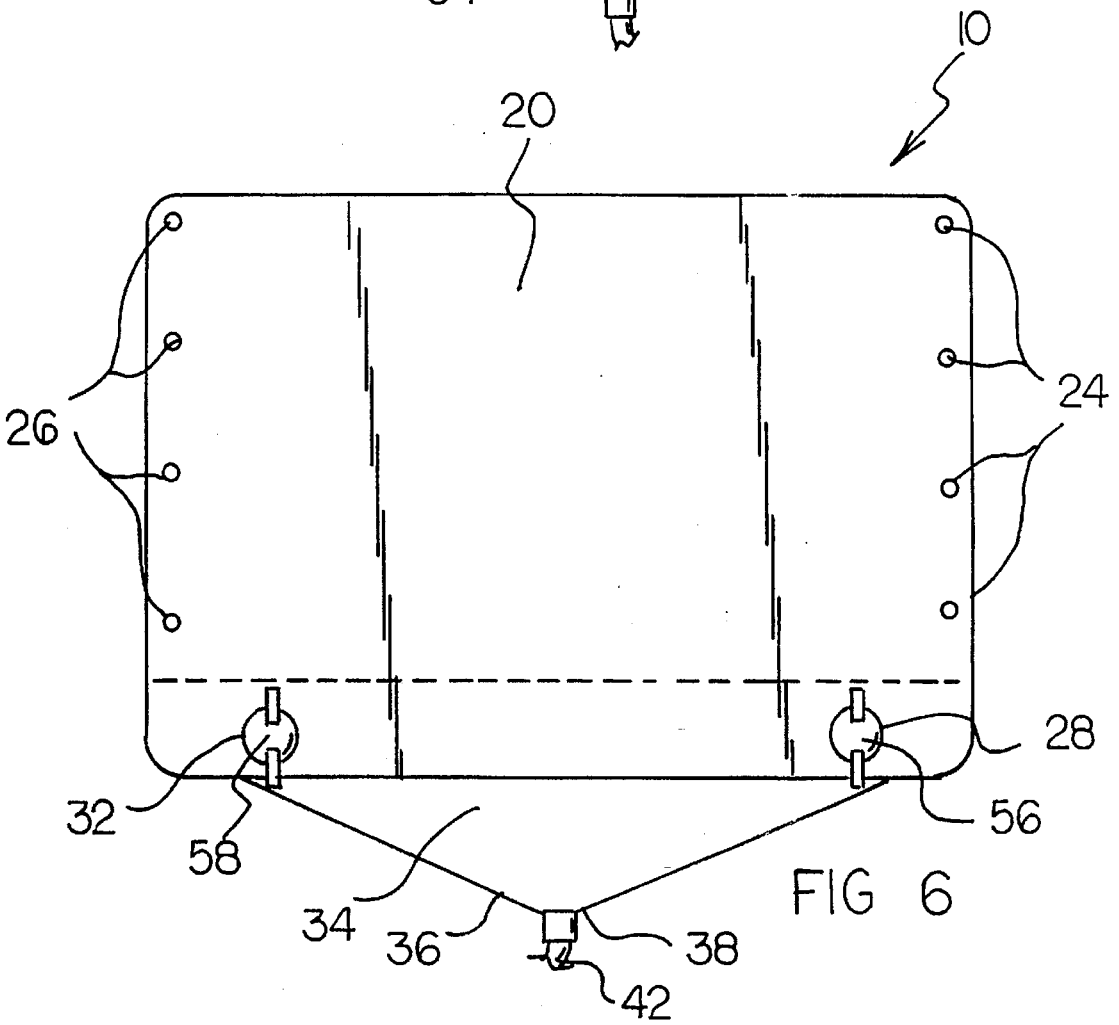
FIG. 6 is a view taken along line 6—6 of FIG. 5.

Furthermore, in order to assist in the mounting of the device, a wall receiving slot 54 is formed intermediate the lower extent of the rear wall 20 and the container 34. This slot can most clearly be seen in FIG. 5. Furthermore, a first screw 56 is threadably received within the first threaded aperture 28 of the rear wall. Likewise, a second screw 58 is threadably received within the second threaded aperture 32 of the rear wall. These first and second screws function in securing a wall within the wall receiving slot 54. Thus, an operator who wishes to secure the device to the edge of a wall, for example, the edge of a bath rub, may insert the wall receiving slot 54 over the edge of a wall. Then, the first and second screws 56 and 58, respectively, can be secured to one of the surfaces of the wall for use in retaining the device upon the wall.

Figure 2:
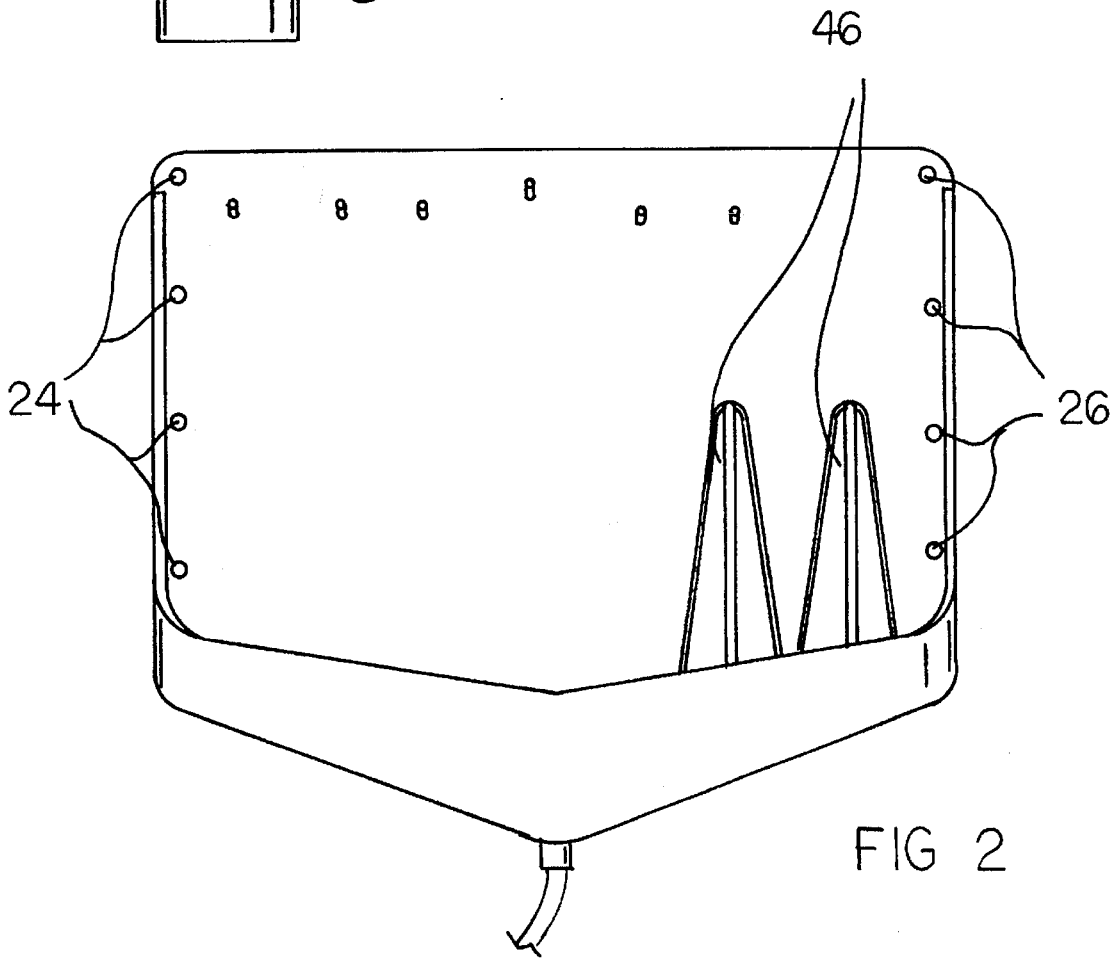
FIG. 2 is a front view of the device of the present invention with brushes and roller not included.

In an alternative embodiment, the device does not include the wall receiving slot 54 or the first and second screws 56 and 58. This embodiment is most clearly seen in FIGS. 1 and 2. With this embodiment, the two sets of vertically aligned apertures 24 and 26 are employed in securing the device to a wall by way of a number of pegs. Thus, in the operation of this embodiment, the user secures the device upon a wall by way of pegs and the two sets of horizontally aligned apertures. Then the user secures a number of paint brushes or rollers into the interior of the device by way of the hooks 22 or the cones 46. Any excess paint is then removed from the brushes and/or roller by way of gravity and is fed into the container and down along the tapered side walls through the tubing and into a receptacle. Then the paint can be disposed or reused. The preferred material for the rear wall and container of the present invention is an impact resistant plastic.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved paint brush and roller draining device comprising, in combination:

a rear wall having an upper extent, a lower extent, a first side and a second side, a plurality of hooks extending outwardly from the upper extent of the rear wall, each of the hooks functioning to support a brush, a first plurality of vertically aligned apertures formed along the first side of the rear wall, a second plurality of vertically aligned apertures formed along the second side of the rear wall wherein each of the vertically aligned apertures function to support the device, a first threaded aperture formed through the lower extent of the rear wall adjacent the first side, a second threaded aperture formed through the lower extent of the rear wall adjacent the second side;

a container with a central extent integrally formed with the rear wall, the container extending forwardly from the rear wall, the container having a bottom surface which tapers inwardly toward the central extent of the container, an aperture formed within the bottom surface of the container at its central extent;

a length of tubing having a first end and a second end, the first end coupled to the aperture of the bottom surface of the container;

a receptacle adapted to receive runoff fluids, the second end of the tubing positioned within the receptacle;

a pair of roller receiving cones, each of the cones being defined by a first blade and a second blade, each of the blades having a broad base and a narrow apex, the first and second blades are positioned 90 degrees relative to each other, the broad base portion of each cone being secured to the bottom surface of the container, each of the cones specifically adapted to have a roller positioned over it;

a wall receiving slot defined intermediate the lower extent of the rear wall and the container; and a first screw threadedly received within the first threaded aperture of the rear wall, a second screw threadedly received within the second threaded aperture of the rear wall, the first and second screws functioning to secure a wall within the wall receiving slot.

2. A paint brush and roller draining device comprising:

a rear wall having an upper extent, a lower extent, a first side and a second side, a plurality of hooks extending outwardly from the upper extent of the rear wall, each of the hooks functioning to support a brush, a first plurality of vertically aligned apertures formed along the first side of the rear wall, a second plurality of vertically aligned apertures formed along the second side of the rear wall wherein each of the vertically aligned apertures function to support the device;

a container with a central extent integrally formed with the rear wall, the container extending forwardly from the rear wall, the container having a bottom surface which tapers inwardly toward the central extent of the container, an aperture formed within the bottom surface of the container at its central extent; and a pair of roller receiving cones, each of the cones being defined by a first blade and a second blade, each of the blades having a broad base and a narrow apex, the first and second blades are positioned 90 degrees relative to each other, the broad base portion of each cone being secured to the bottom surface of the container, each of the cones specifically adapted to have a roller positioned over it.

3. The device as set forth in claim 2 wherein a first threaded aperture is formed through the lower extent of the rear wall adjacent the first side, a second threaded aperture formed through the lower extent of the rear wall adjacent the second side, a wall receiving slot defined intermediate the lower extent of the rear wall and the container and a first screw threadedly received within the first threaded aperture of the rear wall, a second screw threadedly received within the second threaded aperture of the rear wall, the first and second screws functioning to secure a wall within the wall receiving slot.

4. The device as set forth in claim 2 wherein a receptacle is adapted to receive runoff fluids, the second end of the tubing positioned within the receptacle and a length of tubing having a first end and a second end, the first end coupled to the aperture of the bottom surface of the container.

* * * * *